United States Patent [19]

Nielsen et al.

[11] Patent Number: 5,056,276

[45] Date of Patent: Oct. 15, 1991

[54] GUTTER GUARD CONSTRUCTION

[76] Inventors: J. Arne Nielsen, 2903 Riding Trail Ct., Oak Ridge, N.C. 27310; Majid N. Moghaddassi, 2009 Smokeridge La., Greensboro, N.C. 27407

[21] Appl. No.: 523,855

[22] Filed: May 15, 1990

[51] Int. Cl.[5] ..... E04D 13/00

[52] U.S. Cl. ..... 52/12; 210/474

[58] Field of Search ..... 52/12; 210/474

[56] References Cited

U.S. PATENT DOCUMENTS

| | | | |
|---|---|---|---|
| 1,526,821 | 2/1925 | Andrews | 52/12 X |
| 2,469,841 | 5/1949 | Ours | 52/12 |
| 2,734,467 | 2/1956 | Steele . | |
| 2,841,100 | 7/1958 | Moller | 52/12 X |
| 2,948,083 | 8/1960 | Steele . | |
| 3,834,091 | 9/1974 | Dugan | 52/12 |
| 4,036,761 | 7/1977 | Rankin | 52/12 X |
| 4,307,976 | 12/1981 | Butler . | |
| 4,669,232 | 6/1987 | Wyatt . | |
| 4,696,131 | 9/1987 | Schreffler . | |
| 4,807,406 | 2/1989 | Densmore . | |
| 4,841,686 | 6/1989 | Rees . | |
| 4,937,986 | 7/1990 | Way, Sr. et al. | 52/12 |

*Primary Examiner*—Richard E. Chilcot, Jr.
*Attorney, Agent, or Firm*—Rhodes, Coats & Bennett

[57] ABSTRACT

A gutter guard is formed of an elongated flat sheet of perforated metal. The outer edge of the gutter guard is attached to the outer edge or lip of the gutter by several clips. The clips are preferably hinged which permits the gutter guard to pivot around the hinge clip. The inner edge of the gutter guard rests on the roof. A dam or weir juts upwardly from the surface of the perforated metal sheet parallel to and adjacent the outer edge to block or impede the flow of water thereacross. One or more handles are attached to the gutter guard to facilitate dumping of leaves and debris collected thereon. An extension rod having a hook-like head attachment can then be operated from the ground to grasp the handle and rotate the hinged gutter guard about the edge of the gutter.

11 Claims, 3 Drawing Sheets

GUTTER GUARD CONSTRUCTION

BACKGROUND OF THE INVENTION

1. Field of the Invention

This invention relates in general to rain gutters and more particularly to a gutter guard which is so designed as to block the entry of leaves and induce the entry of water into the gutter below.

2. Description of the Prior Art

Rain gutters invariably accumulate foreign debris, for example, leaves and pine needles, and thereby become clogged. Such debris must be removed manually, usually by a person on a ladder or on the roof. In the past, gutter guards have been developed which address the problem of accumulating debris. Gutter guards are conventionally screens laid atop the gutter to block debris from entering the gutter in the first place. Some gutters have been developed which include devices for removal of debris after it has accumulated therein.

Gutter guards are difficult and time-consuming to install and often do not function satisfactorily. It is often necessary to drill holes in the gutter or otherwise impair its integrity. Gutter guards are conventionally installed atop the gutter mouth and beneath the roof edge. As such, they are generally horizontal. Debris will accumulate on the surface of the guard which blocks the flow of water into the gutter. The water is then deflected off the edge and onto the ground therebeneath. It is therefore necessary to remove the accumulated debris off the gutter guard. This is usually done manually from a ladder, just as it was done with the gutter.

The following patents are hereby referenced as being typical of some improvement in which the surface is slightly tilted:

| U.S. Pat. No. | Inventor |
|---|---|
| 4,841,686 | Herbert R. Rees |
| 2,948,083 | Homer M. Steele |
| 2,734,467 | Homer M. Steele |

In heavy rain, however, these guards tend to guide the flow of across the entrance to the gutter and over its edge, thereby defeating the very purpose of the gutter.

Another type of previously known gutter guard is bowed upwardly convex and hinged on the outside edge of the gutter (U.S. Pat. No. 4,307,976 to Butler). The bowed shape acts as a collector for debris, ice and snow. Ice and snow may exert dangerously high pressure on the apparatus with resulting deformation, damage, and/or destruction. Although the guard is hinged, it cannot be opened without first removing the debris which has been trapped between the inner edge and the roof.

Other previously know gutter guards are vinyl and are inserted in an upwardly bow-shape. These guards do not hold up well under pressure from ice and snow and they lose their effectiveness in extreme temperatures.

The following patents are hereby referenced as being typical of the known prior art insofar as they disclose pivoted rain gutters which gutters are so designed as to be tiltable from the ground to thereby dump their contents:

| U.S. Pat. No. | Inventor |
|---|---|
| 4,807,406 | John Densmore |
| 4,696,131 | Robert E. Schreffler |
| 4,669,232 | Robert L. Wyatt |

In addition to being very expensive, such gutters are not dumped until they have become clogged with debris. A large quantity of debris and accumulated water is then dumped all at once on or near the person who is manipulating the gutter. As with standard gutters, such gutters are difficult to fully clean from the ground. Overall, it is preferable to prevent the debris from accumulating in the gutters in the first place.

Accordingly, it is an object of this invention to provide an improved gutter guard which effectively 1) prevents leaves and debris from collecting in the gutter, 2) blocks the free passage of rain water thereover and encourages water to collect in the gutters, and 3) encourages leaves and debris to be blown off the guard by the combined forces of wind and gravity.

It is a further object of this invention to provide an improved gutter guard which is easily installed and removed without the effecting the integrity of the gutter.

It is a further object of this invention to provide an improved gutter guard which is durable, does not collapse under the pressure of snow and ice, and is resistant to extreme temperatures.

It is a further object of this invention to provide a gutter guard of the type described which is hinged and can be easily manipulated from the ground so that debris which has accumulated on top of it is dumped.

It is a further object of this invention to provide an extension rod which can be used from the ground to manipulate the hinged gutter guard as described above.

SUMMARY OF THE INVENTION

The gutter guard itself is made from flat perforate sheet or screen stock. The sheet is provided with an upstanding dam or weir which blocks the free passage of water over the outer edge of the gutter guard. The outer edge of the gutter guard is attached to the outer edge of the gutter by means of one or more clips which are preferably hinged to permit the guard to be moved in an arcuate path around the outer edge or lip of the gutter to dump debris collected thereon. The inner edge of the gutter guard rests on the roof. One or more handles extend from the inner edge across the surface of the guard and include a portion that protrudes outwardly beyond the gutter. An extension rod having a hook-like head attachment can then be operated from the ground to grasp the handle and move the hinged gutter guard in the aforesaid arcuate path.

DETAILED DESCRIPTION OF THE INVENTION

Figure 1:
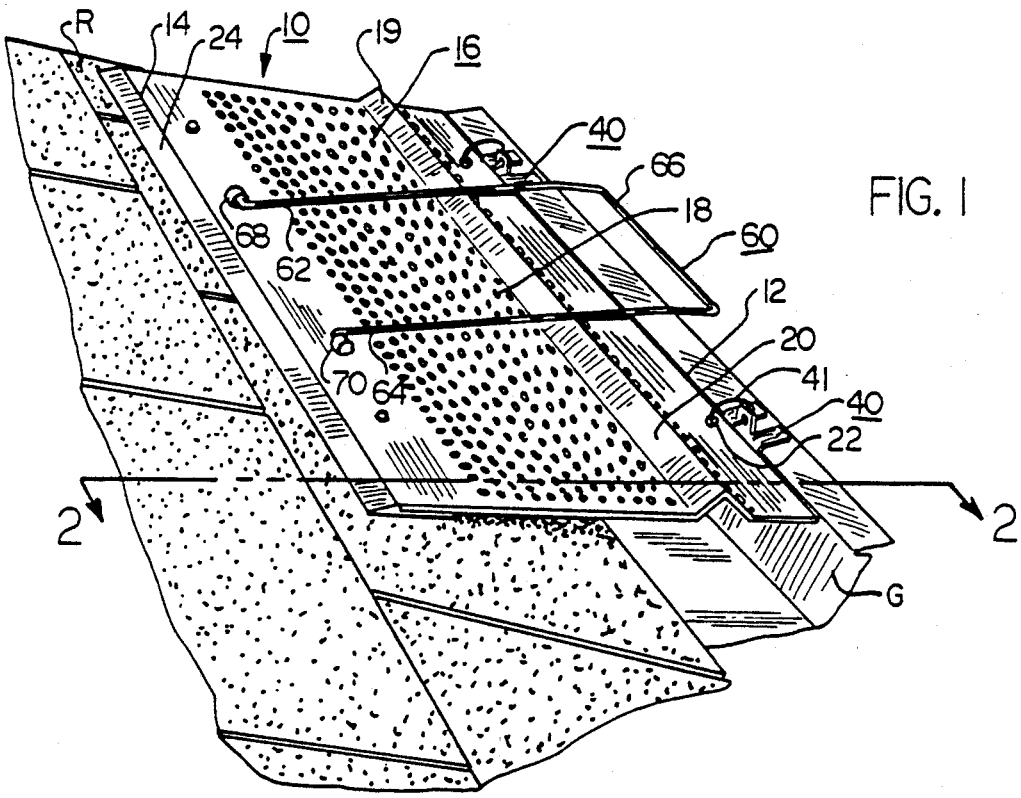
FIG. 1 is a perspective view of the gutter guard of the present invention installed on a conventional gutter.
Figure 1A:
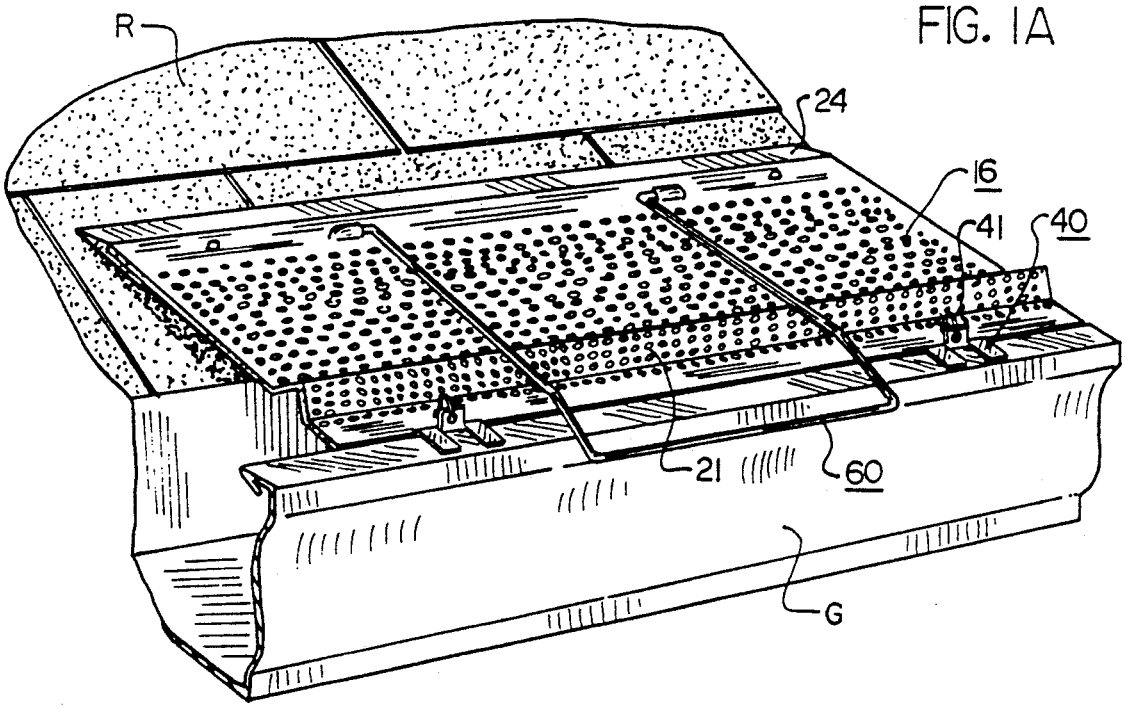
FIG. 1A is a perspective view, with parts broken away, illustrating the gutter guard from the top, front, and one side.

Turning now to the drawings, there is illustrated in FIG. 1 a conventional roof R having a pitch in the range of 35°–45°. A conventional gutter G is attached to the eaves of the house to extend beneath the lower edge of the roof to collect rainwater therein. The gutter guard 1 of the present invention includes an outer edge 12 and an inner edge 14.

Figure 2:
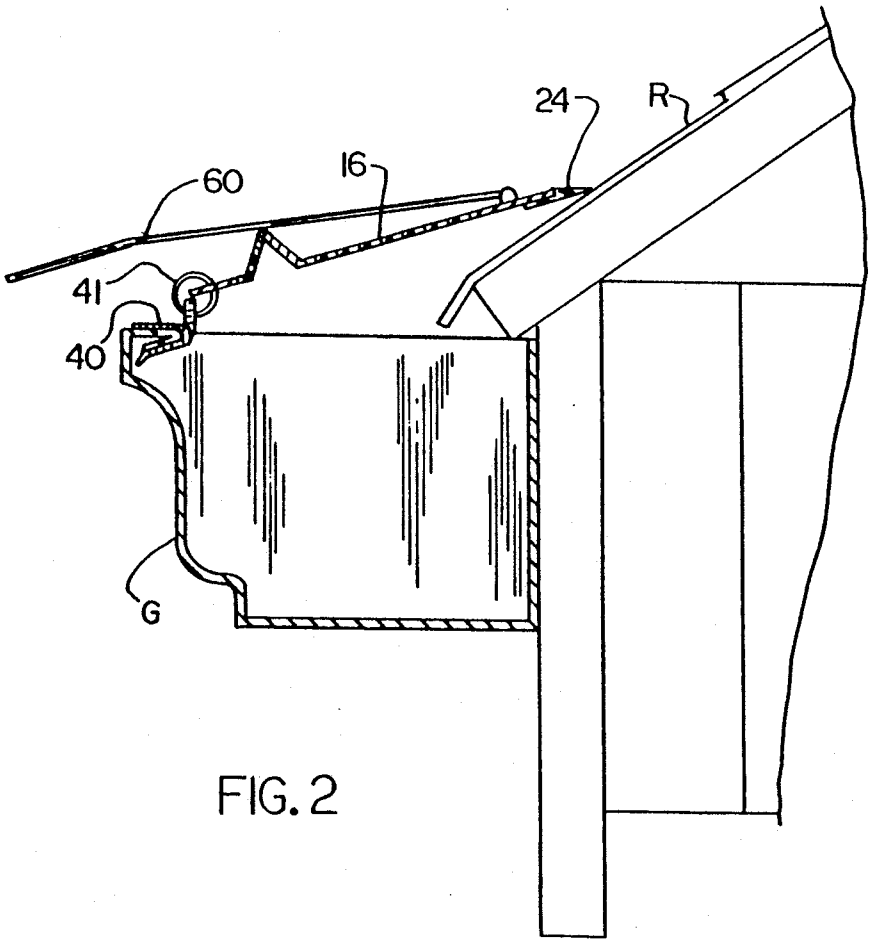
FIG. 2 is a sectional view taken substantially along lines 2—2 in FIG. 1.
Figure 3:
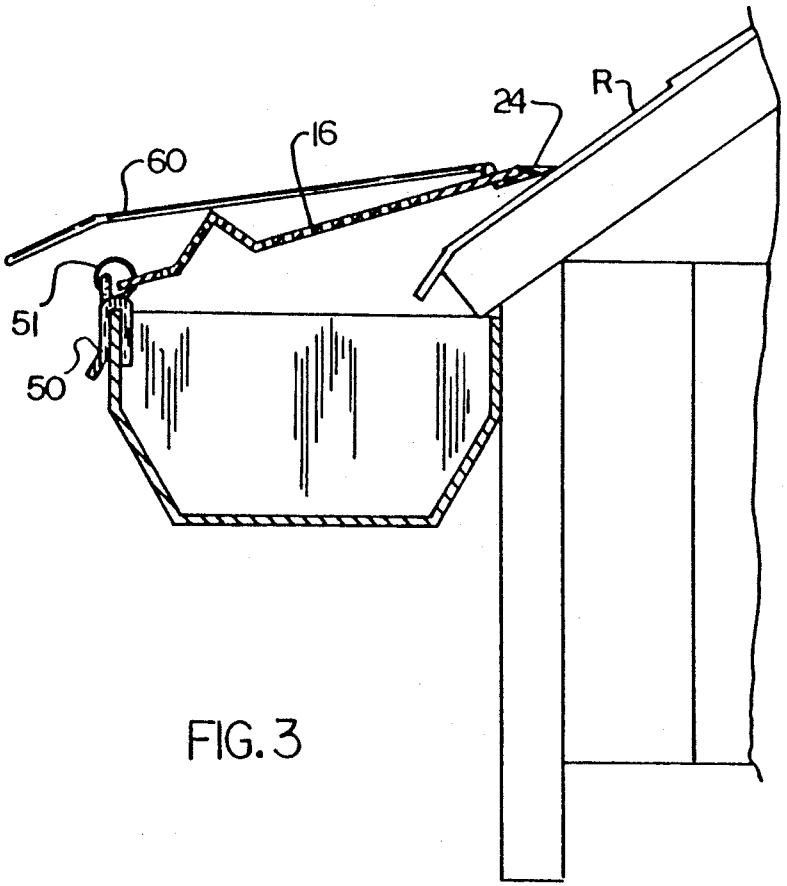
FIG. 3 is a sectional view similar to FIG. 2 except illustrating a second kind of gutter for which the invention is adapted.

The outer edge 12 is attached to the lip of the gutter G by one or more clips 40 which are constructed as described hereinbelow depending on whether the gutter G includes an inwardly turned lip (FIG. 2) or an upturned outer lip (FIG. 3). The inner edge 14 is unattached, but rests upon the surface of the roof R at a point several inches above the edge. The width of the guard is such as to form an angle with the horizontal in the range of 5° to 30°. Generally the smaller the angle, the more effective the collection of water.

The gutter guard 10 includes an elongated, generally planar body member 16. While the body member 16 may be of many sizes, a length of 36 inches and a width of 7 inches is representative to facilitate easy handling and installation by a single worker. The material of body member 16 may be metallic or polymeric and may be a screen or perforated sheet stock. However, in a preferred embodiment, 22 gauge, #3003 aluminum has been found to provide excellent results. The sheet stock is perforated with ¼ inch openings 18. A dam or weir 20 extends upwardly from the surface a distance of ½ to ⅝ inch along a line extending parallel to and approximately 1¼ to 1½ inches form the outer edge 12.

The planar body member with the spaced ¼" round holes prevents most debris from getting stuck as would be the case with the mesh type gutter guards. This construction also prevents pine needles from getting stuck in the guard.

The natural position of pine needles landing on the flat surface of gutter guard is random. Smoothness of this surface allows the needle to turn around and line up with the dam by the force of down draft and the rain water running over the guard. When enough debris is built up behind the dam, they will automatically be pushed up over the dam since the angle and height of the dam is such that it would not prevent this action.

When properly installed, the rainwater washes down the roof R and onto the surface of the gutter guard 10. The dam or weir is very important to impede the flow of water and cause it to enter the gutter G through perforations 18 rather than merely washing across the surface as occurs in other types of gutter guards. The perforated body member 16 prevents leaves and debris from falling into the gutter G. As the leaves and debris dry, they tend to blow off the gutter guard 10 rather than accumulate thereon. The perforations should cover substantially the entire width of the area of body member 16 above gutter G and upstream of dam 20, but do not need to extend across the area of body member 16 which lies atop the roof portion adjacent inner edge 14. Preferably, perforations 18 are provided on the area of the body member 16 above the dam 20 and on the downstream inclined surface 21 of the dam 20, but not on the upstream inclined surface 19. The reasons is that pine needles may get caught in perforations 18 on the inclined surface 19.

While the construction described above generally cover the broader aspects of the invention, there are several additional features to be discussed. First, it is desired that the body member 16 be pivotal about the outer lip of gutter G, so that the guard 10 may be selectively inverted and emptied of leaves and debris. In gutters of the type illustrated in FIG. 2, the outer lip is inturned. Therefore, a first type of clip 40 has been designed to connect the outer edge 12 of body member 16 thereto. For this purpose, the clip 40 (FIG. 5) includes a pair of spaced walls 42,44 joined by an arcuate spring portion 46. A connecting flange 48 with an opening 49 therein extends perpendicularly to the parallel planes formed by walls 42,44. As illustrated in FIG. 2, the outer edge 12 of body member 16 is connected to the gutter lip by two clips 40 each having an interconnecting ring 41 which is inserted through opening 49 in flange 48 and a cooperating opening 22 adjacent the outer edge 12 of body member 16.

Figure 6:
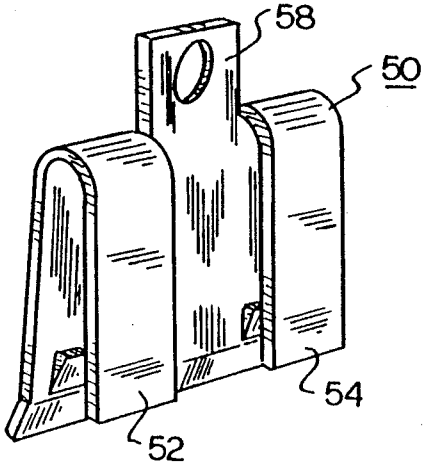
FIG. 6 is a perspective view of a connecting clip used for gutters of the type illustrated in FIG. 3.

Correspondingly in gutters of the type illustrated in FIG. 3, the outer lip is vertical. The second type of clip 50 (FIG. 6) includes a connecting flange 58 that extends parallel to the pair of spaced wall 52,54. Again two clips 50 connect the outer edge 12 of body member 16 to the gutter lip by means of rings 51 (FIG. 3).

An operating handle 60 comprises a generally U-shaped wire member having a pair of legs 62,64 connected by a base 66. The ends of legs 62,64 are pivotally attached to two spaced connecting tabs 68,70 which are formed upwardly from the surface of body member 16 adjacent the inner edge 14. The legs 62,64 are of such length that the base 66 extends out over outer edge 12 and the lip of gutter G where the handle 60 may be grasped to invert the gutter guard as illustrated in FIG. 2.

Figure 5:
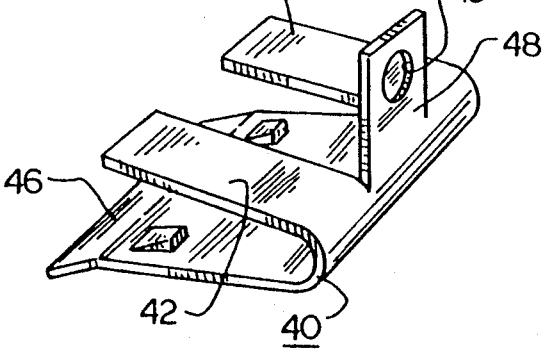
FIG. 5 is a perspective view of a connecting clip used for of the type illustrated in FIG. 2.
Figure 4:
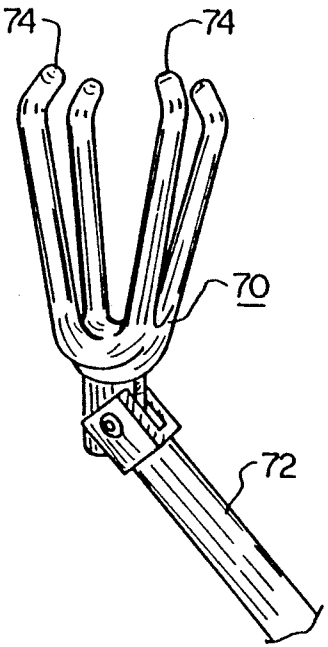
FIG. 4 is a perspective view of the upper end of a tool used for grasping and arcuately moving the guard to dump debris collected thereon.

An operating tool 70 is illustrated in FIG. 5 and includes an extension shaft 72 with a plurality of spaced fingers 74 at one end. The upper end of each finger includes an inwardly inclined portion and the tips of each finger are rounded. This construction prevents interference with the gutter lip as the operator is attempting to engage the handle 60. An operator standing on the ground can insert the fingers 74 around the base 66 of handle 60. The operator then pulls the guard 10 upwardly and outwardly from its normal position resting against the surface of the roof. As the guard is moved arcuately about the lip of the gutter, it is inverted and the leaves and debris fall to the ground. Again, while the hinged attachment of the gutter guard is not necessary in all installations, it is desirable for gutters on which accumulate a large amount of leaves and debris.

Finally, the inner edge 14 is provided with a rubber or elastomeric strip 24 along the edge. The purpose of the strip 24 is to provide some semblance of a seal between the inner edge 14 and the surface of the roof. Because of the irregular surface caused by the shingles and the possibility that inner edge 14 might become bent or deformed, the strip 24 minimizes the space therebetween. This prevents debris and leaves from getting beneath the guard 10.

The above described embodiments are merely illustrative of the principles of the invention. It will be apparent, for example, that the parts may be made of other material in different shapes and that they may be engaged with different types of attachments while still incorporating the spirit and scope of the invention. Numerous other variations and modifications in the above-described elements will be readily apparent to those skilled in the art without departing from the spirit and scope of the invention as expressed in the appended claims.

We claim:

1. A gutter guard for use with rain gutters of the type which are attached to the eaves of a house and extend beneath the roof edge thereof, wherein the gutter includes an outer edge and an elongated trough, said gutter guard comprises:

a) generally planar body member having an inner edge and an outer edge;

b) means for attaching said outer edge of said body member to the outer edge of said gutter with said inner edge resting on the roof, the width of said body member being such that said gutter guard, when so positioned, forms an angle with the horizontal in the range of 5°–30°;

c) said body member containing a relatively wide, flat perforate portion overlying at least the entirety of the elongated trough of said gutter and a single weir extending upwardly from the surface thereof along a line extending parallel to and adjacent said outer edge, said perforate portion containing a multiplicity of openings therein of approximately ¼ inch in diameter;

d) said weir having an imperforate upstream inclined surface impeding the flow of water across the surface of said body member, causing said water to enter said perforate portion.

2. The gutter guard according to claim 1 wherein said body member further includes a resilient strip extending along said inner edge.

3. The gutter guard according to claim 1 wherein said gutter guard is formed of sheet metal in a generally elongated rectangular shape.

4. The gutter guard according to claim 1 wherein said means for attaching the outer edge of said body member to the outer edge of said gutter comprises a clip member including a pair of parallel spaced walls which receive the outer edge of the gutter therethrough and an upstanding tab member extending upwardly therefrom, said tab member including an opening therein, a connector member extending between the opening in said tab and an opening in the outer edge of said body member.

5. The gutter guard according to claim 1 wherein said means for attaching the outer edge of said gutter guard to the outer edge of said gutter further comprises means for selectively moving the gutter guard between a normal position with the inner edge thereof resting on the roof and an open position in which the body member is pivoted around the outer edge of said gutter to an inverted second position, whereby leaves and debris deposited on said gutter guard will be emptied.

6. The gutter guard according to claim 5 wherein said means for attaching the outer edge of the gutter guard to the outer edge of the gutter includes at least one hinged clip.

7. The gutter guard according to claim 6 wherein said hinged clip comprises:

a) a pair of spaced walls with a spring-like connection means therebetween for receiving the edge of said gutter;

b) a tab extending upwardly from said clip;

c) an opening in the tab;

d) a corresponding opening adjacent the outer edge of said body member; and e) a ring which is inserted through the openings in said body member and said tab to hingedly connect the two members.

8. The gutter guard according to claim 1 wherein said weir is in the form of an elongated V-shape extending substantially the entire length of said body member and protruding upwardly from the surface of said body member a distance in the range of ½–⅝ inches.

9. The gutter guard according to claim 8 wherein said V-shaped weir is formed by an upstream inclined surface and a downstream inclined surface, said upstream inclined surface being devoid of said perforations.

10. The gutter guard according to claim 5 and further including a generally U-shaped operating handle having a pair of legs and a base, wherein the terminal portions of said pair of legs are pivotally attached to the body member at points adjacent the inner edge thereof and wherein said legs are of such length that the base extends outwardly past the outer edge of said body member and said gutter, whereby the handle may be operated by a person standing on the ground utilizing an operating tool.

11. The gutter guard acoording to claim 5 wherein said body member further includes a resilient strip extending along the inner edge thereof.

* * * * *